US006372397B1

(12) United States Patent
Maruyama et al.

(10) Patent No.: US 6,372,397 B1
(45) Date of Patent: Apr. 16, 2002

(54) ELECTROPHOTOGRAPHIC PHOTOSENSITIVE MEMBER, PROCESS CARTRIDGE AND ELECTROPHOTOGRAPHIC APPARATUS

(75) Inventors: Akio Maruyama, Tokyo; Toshihiro Kikuchi, Yokohama; Shoji Amamiya, Numazu; Michiyo Sekiya, Mishima; Hiroki Uematsu, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/475,180

(22) Filed: Dec. 30, 1999

(30) Foreign Application Priority Data

Jan. 6, 1999 (JP) ..... 11-001103

(51) Int. Cl.[7] ..... G03G 5/05; G03G 5/047

(52) U.S. Cl. ..... 430/59.6; 430/56; 430/66; 430/67; 430/96; 399/116; 399/159

(58) Field of Search ..... 430/56, 59.6, 96, 430/66, 67, 130; 399/116, 159

(56) References Cited

U.S. PATENT DOCUMENTS

| | | | | |
|---|---|---|---|---|
| 4,296,190 A | * | 10/1981 | Hasegawa et al. | 430/96 |
| 4,461,819 A | | 7/1984 | Nakagawa et al. | 430/95 |
| 4,798,777 A | | 1/1989 | Takiguchi et al. | 430/84 |
| 4,985,330 A | | 1/1991 | Tsuchiya et al. | 430/130 |
| 5,272,029 A | * | 12/1993 | Sakai et al. | 430/67 |
| 5,352,552 A | | 10/1994 | Maruyama et al. | 430/18 |
| 5,391,449 A | | 2/1995 | Maruyama et al. | 430/66 |
| 5,411,827 A | | 5/1995 | Tamura et al. | 430/64 |
| 5,422,210 A | | 6/1995 | Maruyama et al. | 430/66 |
| 5,455,135 A | | 10/1995 | Maruyama et al. | 430/58 |
| 5,585,214 A | | 12/1996 | Kashimura et al. | 430/96 |
| 5,811,212 A | * | 9/1998 | Tanaka | 430/56 |
| 6,016,414 A | | 1/2000 | Anayama et al. | 399/159 |
| 6,180,303 B1 | * | 1/2001 | Uematsu et al. | 430/59.6 |
| 6,200,715 B1 | * | 3/2001 | Fuller et al. | 430/59.6 |

FOREIGN PATENT DOCUMENTS

| | | | |
|---|---|---|---|
| EP | 0368251 | 5/1990 | |
| EP | 0493054 | 7/1992 | |
| JP | 57-163239 | * 10/1982 | |
| JP | 127652 | 5/1990 | |
| JP | 5-323630 | * 12/1993 | 430/96 |
| JP | 143645 | 1/2000 | |

OTHER PUBLICATIONS

Derwent Abstract No. 1982–98259E (Oct. 1982), describing Japanese Patent 57–163239.*

Derwent Abstract No. 1994–018728 (Dec. 1993), describing Japanese Patent 5–323630.*

Patent Abstracts—Japan, vol. 007, No. 002 (P–166) Jan. 7, 1983 of JP 57–163239.

Patent Abstracts—Japan, vol. 009, No. 273 (P–401) Oct. 30, 1985 of JP 60118842.

Database WPI, Section Ch, Week 199645, Derwent Publ., AN1996–446899 XP002135662.

* cited by examiner

*Primary Examiner*—Janis L. Dote
(74) *Attorney, Agent, or Firm*—Fitzpatrick, Cella, Harper & Scinto

(57) ABSTRACT

An electrophotographic photosensitive member is constituted by a support and a photosensitive layer disposed on the support. The photosensitive layer comprises a charge-transporting material and a resin obtained by radiation curing of a compound having a functional group represented by the following formula (1):

(1)

wherein Ar denotes a substituted or unsubstituted arylene group and $R_1$ denotes a hydrogen atom or methyl group.

14 Claims, 1 Drawing Sheet

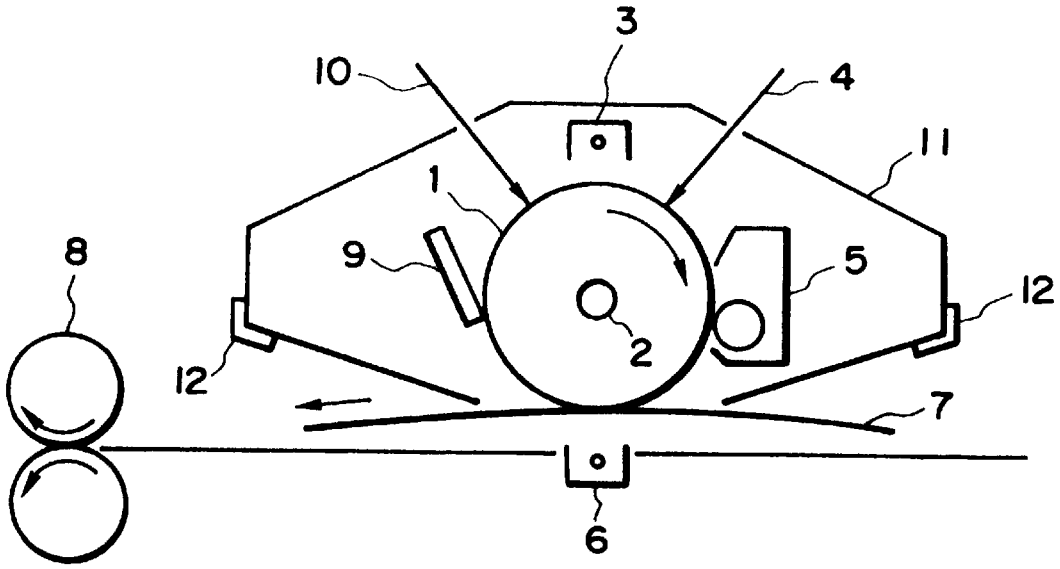
3
10
4
11
1
9
5
8
12
2
12
7
6

ELECTROPHOTOGRAPHIC PHOTOSENSITIVE MEMBER, PROCESS CARTRIDGE AND ELECTROPHOTOGRAPHIC APPARATUS

FIELD OF THE INVENTION AND RELATED ART

The present invention relates to an electrophotographic photosensitive member, particularly one having a surface layer comprising a specific resin, a process cartridge and an electrophotographic apparatus including the electrophotographic photosensitive member, and a process for producing the electrophotographic photosensitive member.

In recent years, as photoconductor materials for use in electrophotographic photosensitive members, organic photoconductor materials are noted for their advantages, such as high productivity and non-pollution characteristic and have been widely used.

In many cases, there have been used function separation-type electrophotographic photosensitive members having a structure including a charge generation layer and a charge transport layer in lamination so as to satisfy both electrical and mechanical characteristics. On the other hand, an electrophotographic photosensitive member is required to satisfy sensitivity, electrical characteristic, optical characteristic and durability corresponding to an electrophotographic process where it is used, as a matter of course.

Particularly, the surface of a photosensitive member is directly subjected to various electrical and mechanical external forces during various steps of charging, exposure, development with a toner, transfer onto paper and cleaning, so that durability against these forces is required. More specifically, the photosensitive member is required to exhibit durability against lowering in photosensitivity, lowering in chargeability, increase in residual potential, abrasion and occurrence of scars at the surface due to abrasion and also transferability of a toner image and a cleaning performance of a residual toner after the transfer. For that purpose, the photosensitive member is required to have a smaller surface energy and a higher lubricity and it is desirable that these performances are not lowered even on repetitive use.

It has been difficult for the electrophotographic photosensitive member using an organic photoconductor to satisfy the above properties, particularly the durability.

The surface layer of the electrophotographic photosensitive member using an organic photoconductor is generally a thin resin layer, and the property of the resin is very important. As resins satisfying the above-mentioned requirements to some extent, acrylic resin, polycarbonate resin, etc., have been used commercially in recent years. However, this does not mean that all the above-mentioned properties are satisfied by these resins. Particularly, it is difficult to say that these resins have a sufficiently high film hardness in order to realize a higher durability. More specifically, a surface layer of these resins has been liable to cause abrasion or scars during repetitive use.

Further, in compliance with a demand for a higher sensitivity in recent years, relatively large amounts of low-molecular weight compounds, such as a charge-transporting material, are added in many cases. In such cases, a problem is liable to be encountered that such low-molecular weight compounds are precipitated or exuded during a storage of the electrophotographic photosensitive member. Further, when a mechanical oil or a resinous component is attached to the surface of the photosensitive member, a cracking is caused to occur in some cases.

For solving these problems, the use of a cured resin for constituting a charge transport layer has been proposed, e.g., in Japanese Laid-Open Patent Application (JP-A) 2-127652. According to this proposal, the resultant charge transport layer comprising a cured and crosslinked resin has provided remarkably increased surface strength to improve resistances to abrasion, scars, precipitation and cracking during repetitive use.

However, in a charge transport layer composed of an organic charge-transporting material and a cured binder resin, the charge-transporting performance is largely affected by the resin, and in case of using a cured resin layer having a sufficiently high hardness, the charge-transporting performance is liable to be lowered to result in an increased residual potential on repetitive use, so that it has not fully succeeded in satisfying both the hardness and charge-transporting performances at higher levels.

SUMMARY OF THE INVENTION

A generic object of the present invention is to provide an electrophotographic photosensitive member having solved the above mentioned problems.

A more specific object of the present invention is to provide an electrophotographic photosensitive member having a surface layer exhibiting a high film strength leading to improved anti-abrasion and anti-scar characteristics, and also good anti-precipitation and anti-cracking characteristics.

Another object of the present invention is to provide an electrophotographic photosensitive member exhibiting very little change or deterioration of photosensitive member performances, such as increase in residual potential in repetitive use, thus being capable of exhibiting stable performances in repetitive use.

A further object of the present invention is to provide a process cartridge and an electrophotographic apparatus including such an electrophotographic photosensitive member, capable of retaining high-quality image-forming performances for a long period.

A still further object of the present invention is to provide a process for producing such an electrophotographic photosensitive member.

According to the present invention, there is provided an electrophotographic photosensitive member, comprising:

a support and a photosensitive layer disposed on the support, wherein the photosensitive layer comprises a charge transporting material and a resin obtained by radiation curing of a compound having a functional group represented by the following formula (1):

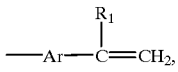

(1)

wherein Ar denotes a substituted or unsubstituted arylene group and $R_1$ denotes a hydrogen atom or methyl group.

According to the present invention, there is also provided a process cartridge, comprising: the above-mentioned electrophotographic photosensitive member and at least one means selected from the group consisting of charging means, developing means and cleaning means; said electrophotographic photosensitive member and said at least one means being integrally supported and detachably mountable to a main assembly of an electrophotographic apparatus.

The present invention further provides an electrophotographic apparatus, comprising: the above-mentioned electrophotographic photosensitive member, and charging means, developing means and transfer means respectively disposed opposite to the electrophotographic photosensitive member.

According to another aspect of the present invention, there is provided a process for producing an electrophotographic photosensitive member, comprising a photosensitive layer-forming step of forming a photosensitive layer containing a charge-transporting material as a surface layer on an electroconductive support; the photosensitive layer-forming step including a step of radiation-curing a compound having the above-mentioned functional group of the formula (1).

These and other objects, features and advantages of the present invention will become more apparent upon a consideration of the following description of the preferred embodiments of the present invention taken in conjunction with the accompanying drawing.

BRIEF DESCRIPTION OF THE DRAWING

The sole FIGURE in the drawing illustrates an electrophotographic apparatus equipped with a process cartridge including-an electrophotographic photosensitive member according to the invention.

DETAILED DESCRIPTION OF THE INVENTION

The electrophotographic photosensitive member according to the present invention is characterized by having a photosensitive layer comprising a charge-transporting material and a resin obtained by radiation curing of a compound having a functional group represented by the above-mentioned formula (1).

In the present invention, the photosensitive member may assume any structure comprising, on a support, a photosensitive layer of a laminate structure including a charge generation layer comprising a charge-generating material and a charge transport layer comprising a charge-transporting material disposed in this order, a laminate structure including these layers in a reverse structure, or a single-layer structure containing the charge-generating material and the charge-transporting material in the same layer.

In any of the above-mentioned layer structures, it is sufficient for the present invention that the photosensitive layer structure includes a surface layer comprising a charge-transporting material and the above-mentioned resin obtained by radiation curing of a compound having a functional group of the formula (1).

However, in view of performances of the resultant electrophotographic photosensitive member, particularly electrical performances, such as residual potential, and durability, the function-separation-type photosensitive layer structure including the charge transport layer as a surface layer is preferred, and an advantage of the present invention is to allow the use of the radiation-cured resin as a binder resin for the surface layer without impairing the charge-transporting performance of the charge-transporting material.

The reason why it is possible to provide a sufficient hardness and to prevent an increase in residual potential without deteriorating the characteristics of the photosensitive member in the case of using the radiation-cured resin in the surface layer has not been clarified.

However, this may be attributable to no or a very small amount of a substance having a larger polarity or a smaller oxidation potential generated during a curing step compared with the conventional cured resins since such a substance (having a larger polarity or a smaller oxidation potential) is considered to adversely affect largely the characteristics of the photosensitive member.

Further, in the case where the compound having a functional group of the formula (1) is cured with heat or ultraviolet (UV) rays, it is necessary to use a thermal- or photo-polymerization initiator. In this case, when the resultant cured resin is used as surface layer of a photosensitive member, an increase in residual potential and a lowering in photosensitivity are liable to be caused. In the present invention, the radiation curing does not require the use of the polymerization initiator, thus being considered that the radiation-cured resin is effective in providing excellent electrophotographic characteristics.

In the above-mentioned formula (1) for the functional group of the compound constituting the radiation-cured resin used in the present invention, Ar denotes an arylene group, examples of which include those obtained by subtracting two hydrogens from benzene, naphthalene, anthracene, phenanthrene, pyrene, quinoline, benzoquinoline, phenothiazine, furan, benzofuran and dibenzofuran. Ar may have a substituent, examples of which include: halogen atoms, such as fluorine, chlorine, bromine and iodine; nitro group; cyano group; hydroxyl group; alkyl groups, such as methyl, ethyl and propyl; alkoxy groups, such as methoxy, ethoxy and propoxy; aryloxy groups, such as phenoxy and naphthoxy; aralkyl group, such as benzyl and phenethyl; aryl groups; such as phenyl and naphthyl; vinyl group; and trifluoromethyl group.

Ar may preferably be an arylene group obtained by subtracting two hydrogens from benzene, naphthalene, anthracene or pyrene.

The compound having the functional group of the formula (1) (hereinbelow referred to as "functional compound" contains at least one functional group of the formula (1) per one molecule and is not particularly limited so long as the compound is a polymerizable compound such that the functional group causes a radiation-initiated polymerization reaction. In the present invention, such a functional compound per se has no charge (hole and/or electron)-transporting performance since a charge-transporting material is used in combination with the functional compound in the surface layer of the photosensitive member and the resultant photosensitive member (having no charge-transporting material does not exhibit electrophotographic performances.

The functional compound (free from charge-transporting performance) used in the present invention may preferably have an oxidation potential of above 1.2 volts or a reduction potential of at least −1.0 volt (absolute value basis). If the oxidation potential is 1.2 volts or below, the injection of charge (holes) from the charge-generating material becomes difficult. Similarly, if the reduction potential is below −1.0 (based on an absolute value), the injection of charge (electron) from the charge-generating material becomes difficult.

The oxidation or reduction potential values referred to herein are based on values measured in the following manner.

<Oxidation or reduction potential measurement>

Measurement is performed by using a saturated calomel electrode as a reference electrode and a 0.1N-$(n\text{-}Bu)_4N^+$ $ClO_4^-$ acetonitrile solution as an electrolytic solution, and sweeping the potentials applied to an operating electrode (of platinum) by means of a potential sweeper to obtain a current-potential curve, on which a peak top potential is taken as an oxidation potential or a reduction potential. More specifically, a sample charge-transporting compound is dissolved in 0.1N-$(n\text{-}Bu)_4ClO_4^-$ acetonitrile solution to provide a concentration of 5–10 mmol. %. Then, the sample solution is supplied with linear increasing voltages of from 0 volt to +1.5 volts (for the oxidation potential) or to −1.5 volts (for the reduction potential) between the operating electrode and the reference electrode dipped in the sample solution to measure current changes, from which a current-potential curve is obtained. On the current-potential curve, a peak (a first peak in case of plural peaks) is determined and a peak-top potential of the peak is taken as an oxidation potential or a reduction potential.

The functional compound may be roughly classified into a monomer and an oligomer based on presence or absence of a recurring unit comprising the functional group of the formula (1). Herein, the monomer means a compound having no recurring unit and having a relatively small molecular weight and the oligomer means a polymer having 2–20 recurring units (each comprising the functional group of the formula (1)). It is also possible to use a macromonomer comprising a polymer or oligomer having the functional group of the formula (1) only at its terminal terminal, as the functional compound for the surface layer of the photosensitive member of the present invention.

In the present invention, the monomer may preferably be used as the functional compound in view of realization of the durability and electrical properties in combination. Other functional compounds (oligomer and macromonomer) may preferably be used in mixture with the monomer.

The functional compound may also be classified based on the number of the functional groups of the formula (1) per one molecule into a monofunctional compound having one functional group and a polyfunctional compound having two or more functional groups. In order to improve the durability, the polyfunctional compound, particularly those having at least three functional groups per molecule may preferably be used.

Preferred examples of the functional compound (having the functional group of the formula (1) in its molecular structure) may include monomers, such as styrene monomer, α-methyl styrene monomer, divinylbenzene and a monomer having isopropenyl; and those shown in Table 1 below (Compound Nos. 1–41), but these are not exhaustive. These compounds may be used singly or in mixture of two or more species.

TABLE 1

| Compound No. | Structural formula |
|---|---|
| 1 | 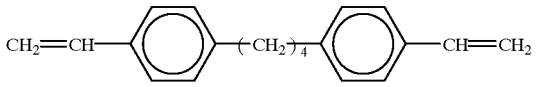 |
| 2 | 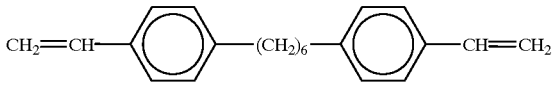 |
| 3 | 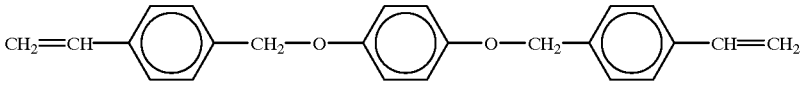 |
| 4 | 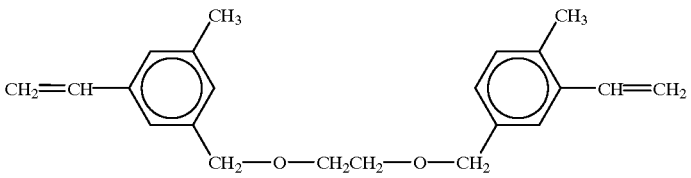 |
| 5 | 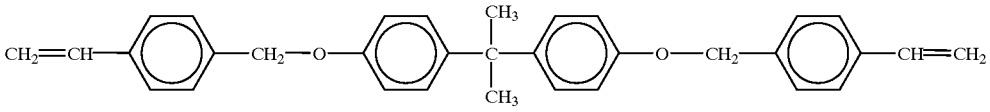 |
| 6 | 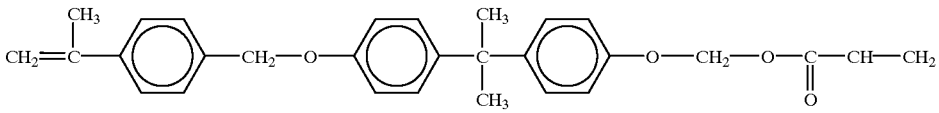 |

TABLE 1-continued
| Compound No. | Structural formula |
|---|---|
| 7 | 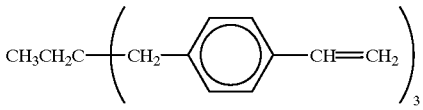 |
| 8 | 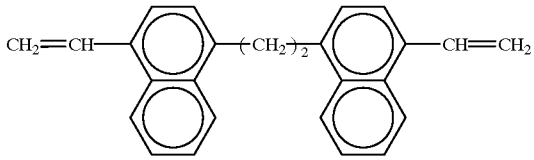 |
| 9 | 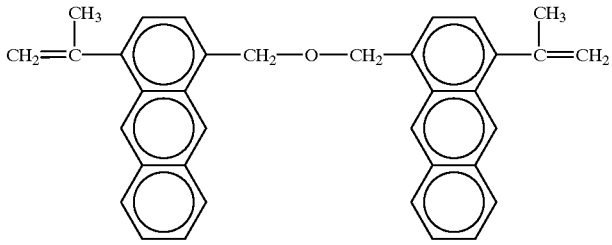 |
| 10 | 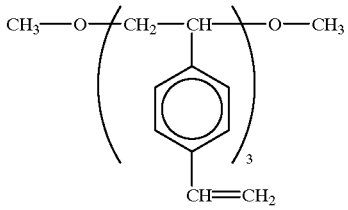 |
| 11 | 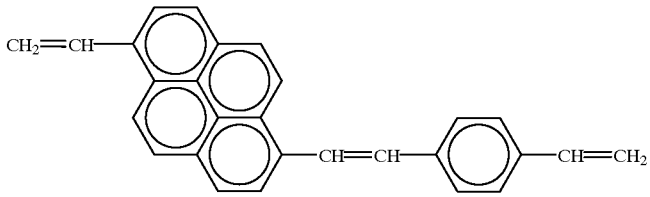 |
| 12 | 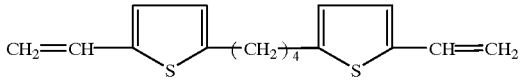 |
| 13 | 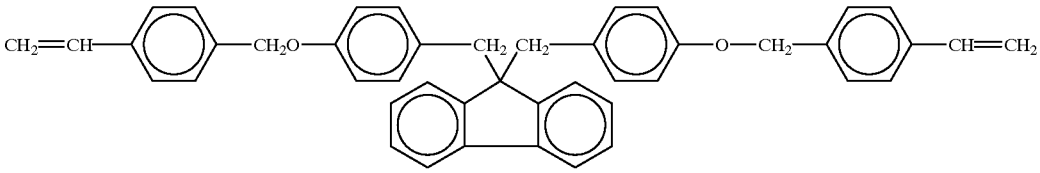 |
| 14 | 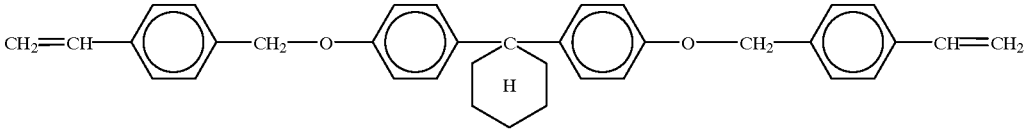 |

TABLE 1-continued
| Compound No. | Structural formula |
|---|---|
| 15 | 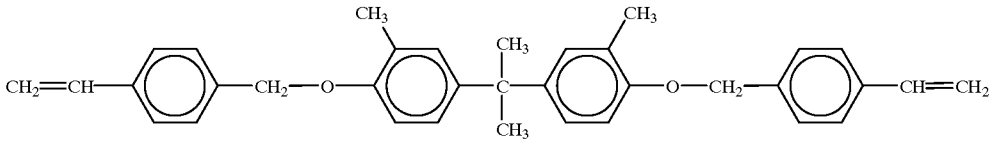 |
| 16 | 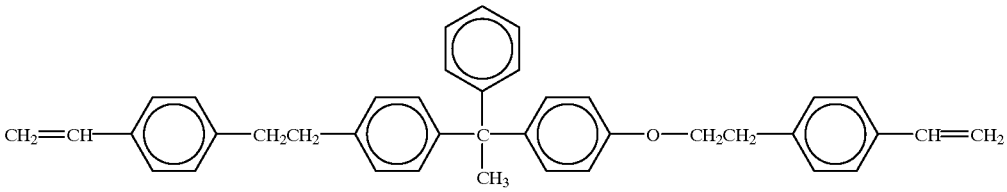 |
| 17 | 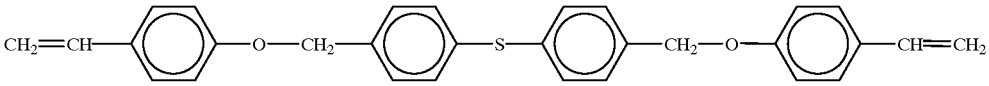 |
| 18 | 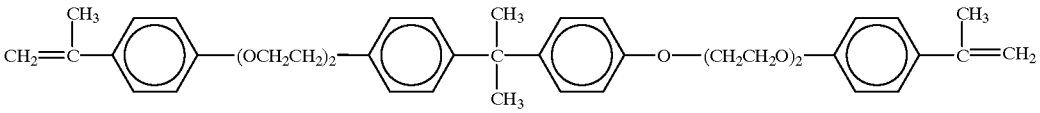 |
| 19 | 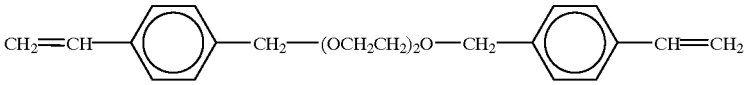 |
| 20 | 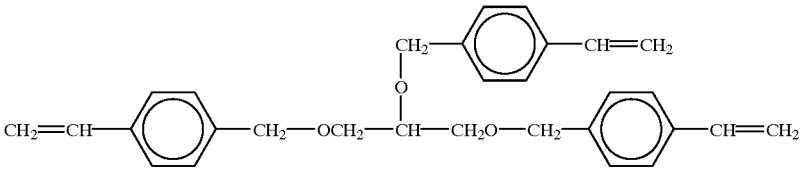 |
| 21 | 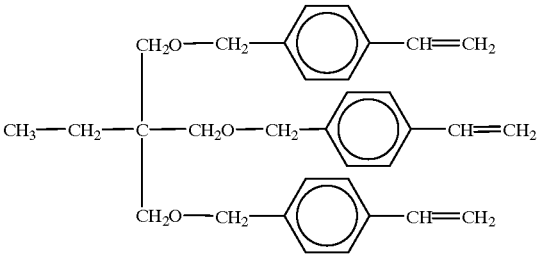 |
| 22 | 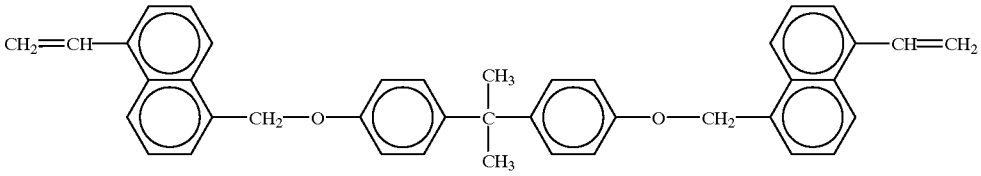 |
| 23 | 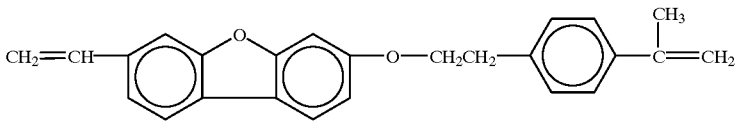 |

TABLE 1-continued
| Compound No. | Structural formula |
|---|---|
| 24 | 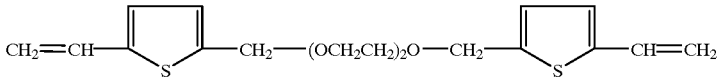 |
| 25 | 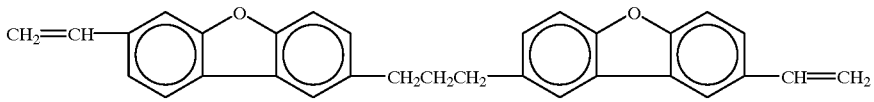 |
| 26 | 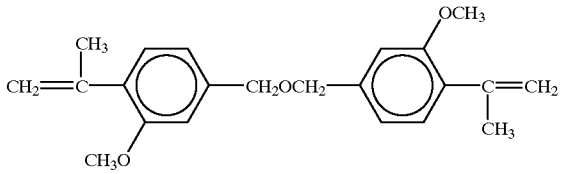 |
| 27 | 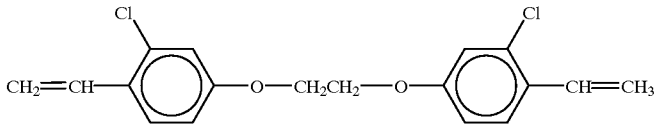 |
| 28 | 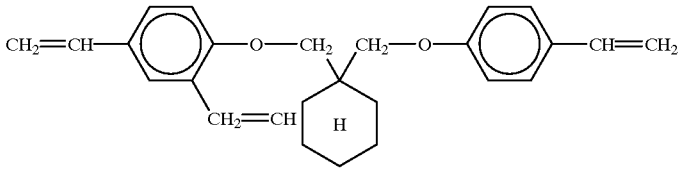 |
| 29 | 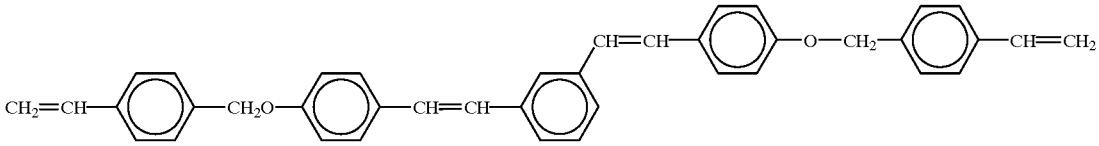 |
| 30 | 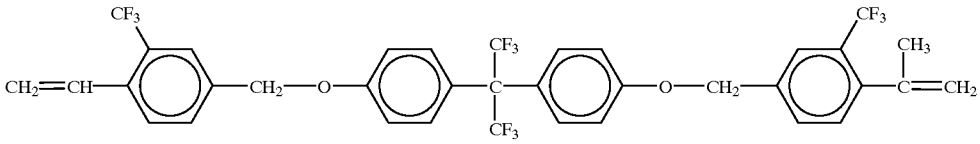 |
| 31 | 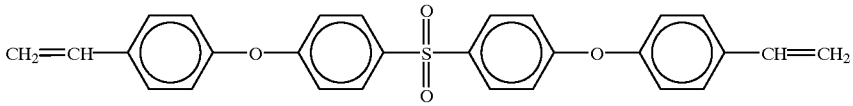 |
| 32 | 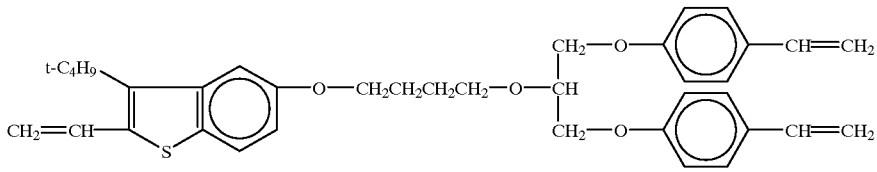 |

TABLE 1-continued
| Compound No. | Structural formula |
|---|---|
| 33 | 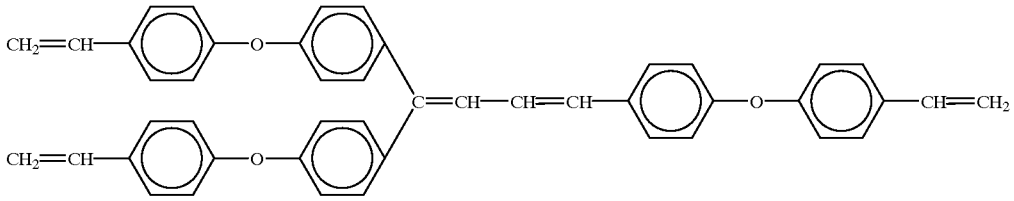 |
| 34 | 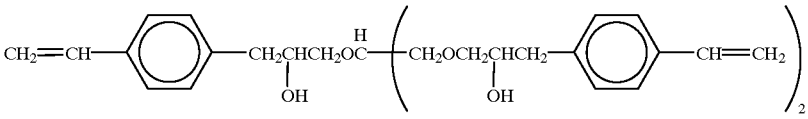 |
| 35 | 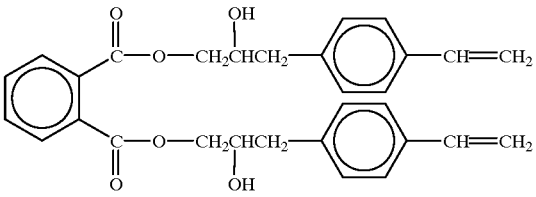 |
| 36 | 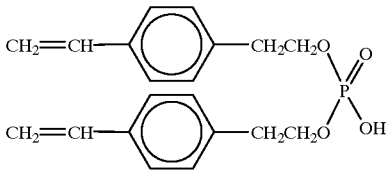 |
| 37 | 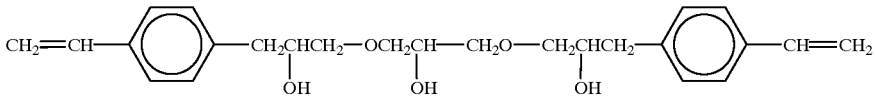 |
| 38 | 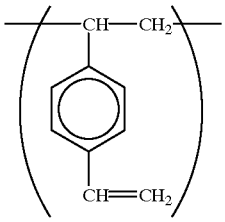 Mw = 2,000 |
| 39 | 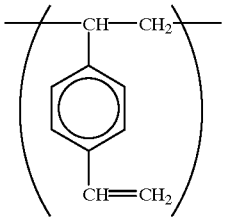 Mw = 5,000 |

TABLE 1-continued

| Compound No. | Structural formula |
|---|---|
| 40 | 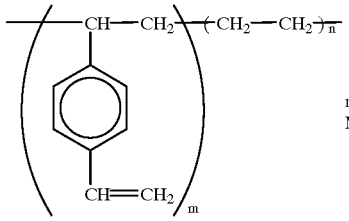 m = n<br>Mw = 5,000 |
| 41 | 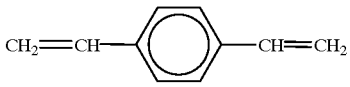 |

As mentioned above, the laminate-type photosensitive layer structure includes a charge generation layer and a charge transport layer.

Examples of the charge-generating material used in the charge generation layer may include: selenium-tellurium, pyrylium and thiapyrylium dyes; phthalocyanine compounds having various central atoms and crystal forms, such as α, β, γ, ∈ and χ-forms; anthrathrone pigments, dibenzpyrenequinone pigments, pyranthrone pigments, trisazo pigments, disazo pigments, monoazo pigments, indigo pigments, quinacridone pigments, asymmetrical quinocyanine pigments, quinocyanines, and amorphous silicon disclosed in JP-A 54-143645.

Such a charge-generating material may be subjected to dispersion together with a binder resin in an amount of 0.3–4 times thereof and a solvent, by means of a homogenizer, an ultrasonic disperser, a ball mill, a vibrating ball mill, a sand mill, an attritor or a roll mill, and the resultant dispersion may be applied and dried to form a charge generation layer. Such a charge generation layer may also be formed of such a charge-generating material alone formed, e.g., by vapor deposition thereof. The charge generation layer may preferably be formed in a thickness of at most 5 μm, particularly 0.1–2 μm.

Examples of the charge-transporting material used in the charge transport layer may include triarylamine compounds, hydrazone compounds, stilbene compounds, pyrazoline compounds, oxadiazole compounds, thiazole compounds and triarylmethane compounds.

When the charge transport layer is a surface layer, the charge transport layer may preferably be formed by dissolving or dispersing the charge-transporting material together with the above-mentioned functional compound in an appropriate solvent and applying and drying the resultant solution onto the charge generation layer, followed by radiation curing. It is also possible to form the charge transport layer by dissolving the charge-transporting material together with a functional compound radiation-cured to some extent in advance in an appropriate solvent and applying and drying the resultant coating liquid onto the charge generation layer. In view of hardness and anti-precipitation property, the former process may preferably be adopted.

The charge transport layer may preferably have a thickness of 1–50 μm, more preferably 3–30 μm.

Examples of the solvent may include: aromatic solvents, such as toluene, xylene and monochlorobenzene; ethers, such as dioxane, tetrahydrofuran and tetrahydropyran; ketones; alcohols; and saturated hydrocarbons. These are selected in view of solute materials.

The solution application may, e.g., be performed by dipping, spray coating, curtain coating or spin coating. Dipping may preferably be employed in order to efficiently mass-produce the photosensitive member.

In the present invention, the charge transport layer may be formed in two or more layers as a laminate structure.

In the case where the charge generation layer is a surface layer, the charge generation layer may preferably be formed on the charge transport layer by dissolving or dispersing the charge-generating material, the charge-transporting material and the functional compound in an appropriate solvent and applying and drying the resultant solution (or dispersion), followed by radiation curing (irradiation).

In the case of the single-layer-type photosensitive layer, the photosensitive layer may preferably be formed by dissolving or dispersing the charge-generating material, the charge-transporting material and the functional compound in an appropriate solvent and applying and drying the resultant solution (or dispersion) onto a support or an undercoating layer (described later), followed by radiation curing. The single-layer-type photosensitive layer may have a thickness of 1–50 μm, preferably 3–30 μm.

In the present invention, when the surface layer is formed, the functional compound may preferably be dried and cured each in a nitrogen gas atmosphere.

The surface layer of the electrophotographic photosensitive member of the present invention can further contain various additives, inclusive of deterioration-preventing agents, such as an anti-oxidant and an ultraviolet absorber, and lubricants, such as tetrafluoroethylene resin particles and fluorinated carbon.

The functional compound used in the present invention may be used in combination of other commercially available resins, such as polycarbonate resin, polyacrylate resin and polystyrene resin within an extent not adversely affecting the effect of the functional compound.

In order to provide excellent electrophotographic characteristics, the photosensitive layer of the photosensitive member according to the present invention may preferably have a smaller relative dielectric constant of at most 4.0, particularly at most 3.0, as measured by a method wherein the photosensitive layer after the radiation curing is subjected to application of an alternating-current (AC) voltage of 1 MHz in combination with an aluminum electrode.

In order to obtain an excellent charge-transporting performance, it is necessary to minimize a degree of charge trapping in the photosensitive layer. The relative dielectric constant may be considered to reflect the degree of charge trapping. In the present invention, the relative dielectric constant varies depending on a molecular structure before the radiation curing and conditions of the radiation curing since the photosensitive member of the present invention employs the radiation-cured resin, different from a thermoplastic resin. Specifically, in order to decrease the relative dielectric constant of the photosensitive layer, it is effective to minimize a polarization within molecule of the functional compound, the number of residual unreacted group after the radiation curing, a degree of deterioration by irradiation, and a curing step and/or drying step before the curing step each effected in a nitrogen gas atmosphere. In the present invention, a means or method for realizing the smaller relative dielectric constant is not particularly limited so long as the resultant relative dielectric constant becomes at most 4.0.

The support for the photosensitive member of the present invention may comprise any material showing electroconductivity. For example, the support may comprise a metal or alloy, such as aluminum or stainless steel, e.g., shaped into a drum (cylinder) form or a sheet form, and paper or a plastic film coated with an electroconductive material depending on an electrophotographic apparatus used.

In the electrophotographic photosensitive member according to the present invention, it is possible to dispose an undercoating (intermediate) layer having a barrier function and an adhesive function between the (electroconductive) support and the photosensitive layer. More specifically, the undercoating layer may be formed for various purposes, such as improved adhesion and applicability of the photosensitive layer, protection of the support, coating of defects of the support, improved charge injection from the support, and protection of the photosensitive layer form electrical breakdown.

The undercoating layer may for example comprise polyvinyl alcohol, poly-N-vinylimidazole, polyethylene oxide, ethylcellulose, ethylene-acrylic acid copolymer, casein, polyamide, N-methoxymethylated 6-nylon, copolymer nylon, glue and gelatin. These materials may be dissolved in a solvent adapted therefor and applied onto the support, followed by drying, to form an undercoating layer in a thickness of, preferably 0.1–2 $\mu$m.

Further, between the support and the photosensitive layer or between the support and the undercoating layer, a resinous (electroconductive) layer containing electroconductive particles disposed therein may be formed in a thickness of, e.g., 5–30 $\mu$m, in order to prevent an occurrence of interference fringe caused during coating of defects of the support or the use of coherent light.

In the present invention, as described above, the functional compound in the surface layer is cured by irradiation (with radiation).

The radiation for the above purpose may include electron beam or rays and $\gamma$-rays, but electron beam or rays (hereinafter represented by "electron beam") may be preferred in view of absorbing efficiency.

The electron beam is generally accelerated by using an accelerator which may be any of scanning type, electrocurtain type, broad beam type, pulse type and laminar type. In performing electron-beam radiation polymerization, in order to provide desired electrical and durability performances, it is important to select appropriate irradiation conditions, which may include an acceleration voltage of preferably 250 kV or below, more preferably 150 kV or below, and a dose in a range of 1–100 Mrad, more preferably 3–50 Mrad. If the acceleration voltage exceeds 250 kV, the photosensitive member performances can be damaged by electron beam irradiation and the smaller relative dielectric constant (of at most 4.0) is not readily achieved. If the dose in below 1 Mrad, the curing or crosslinking is liable to be insufficient, and in excess of 100 Mrad, the photosensitive member performances are liable to be deteriorated and the smaller relative dielectric constant is not readily obtained.

Next, some description will be made on the process cartridge and the electrophotographic apparatus according to the present invention.

The sole FIGURE in the drawing shows a schematic structural view of an electrophotographic apparatus including a process cartridge using an electrophotographic photosensitive member of the invention. Referring to the FIGURE, a photosensitive member 1 in the form of a drum is rotated about an axis 2 at a prescribed peripheral speed in the direction of the arrow shown inside of the photosensitive member 1. The peripheral surface of the photosensitive member 1 is uniformly charged by means of a primary charger 3 to have a prescribed positive or negative potential. At an exposure part, the photosensitive member 1 is imagewise exposed to light 4 (as by slit exposure or laser beam-scanning exposure) by using an image exposure means (not shown), whereby an electrostatic latent image is successively formed on the surface of the photosensitive member 1.

The thus formed electrostatic latent image is developed by using a developing means 5 to form a toner image. The toner image is successively transferred to a transfer (-receiving) material 7 which is supplied from a supply part (not shown) to a position between the photosensitive member 1 and a transfer charger 5 in synchronism with the rotation speed of the photosensitive member 1, by means of the transfer charger 6. The transfer material 7 carrying the toner image thereon is separated from the photosensitive member 1 to be conveyed to a fixing device 8, followed by image fixing to print out the transfer material 7 as a copy outside the electrophotographic apparatus. Residual toner particles remaining on the surface of the photosensitive member 1 after the transfer operation are removed by a cleaning means 9 to provide a cleaned surface, and residual charge on the surface of the photosensitive member 1 is erased by a pre-exposure means (not shown) issuing pre-exposure light 10 to prepare for the next cycle. When a contact charging means (e.g., a charging roller) is used as the primary charger 3 for charging the photosensitive member 1 uniformly, the pre-exposure means may be omitted, as desired.

According to the present invention, in the electrophotographic apparatus, it is possible to integrally assemble a plurality of elements or components thereof, such as the above-mentioned photosensitive member 1, the primary charger (charging means) 3, the developing means 5 and the cleaning means 9, into a process cartridge detachably mountable to the apparatus main body, such as a copying machine or a laser beam printer. The process cartridge may, for example, be composed of the photosensitive member 1 and at least one of the primary charging means 3, the developing means 5 and cleaning means 9, which are integrally assembled into a single unit capable of being attached to or detached from the apparatus body by the medium of a guiding means such as a rail 12 of the apparatus body.

In case where the electrophotographic is a copying machine or a printer, the imagewise exposure light 4 is reflected light or transmitted light from an original, or illumination light given by scanning of laser beam, drive of an LED array or drive of a liquid crystal shutter array based signals formed by reading an original with a sensor.

The electrophotographic photosensitive member according to the present invention can be applicable to electrophotographic apparatus in general, inclusive of copying machines, laser beam printers, CRT printers, LED printers, and liquid crystal shutter-type printers, and further to apparatus for display, recording, light-weight printing, plate forming and facsimile apparatus to which electrophotography is applied.

Hereinbelow, the present invention will be described more specifically with reference to Examples and Comparative Examples wherein "parts" used for describing a relative amount of a component or a material is by weight unless specifically noted otherwise.

EXAMPLE 1

First, a paint for an electroconductive layer was prepared by dispersing 50 parts of electroconductive titanium oxide fine powder coated with tin oxide contacting 10 wt. % of antimony oxide, 25 parts of phenolic resin, 20 parts of methyl cellosolve, 5 parts of methanol and 0.002 part of silicone oil (polydimethylsiloxane-polyoxyalkylene copolymer, number-average molecular weight (Mn)=3000) for 2 hours in a sand mill containing 1 mm-dia. glass beads. The paint was applied by dipping onto a 30 mm-dia. aluminum cylinder and dried at 140° C. for 30 min. to form a 20 μm-thick electroconductive layer.

Then, 5 parts of N-methoxymethylated nylon was dissolved in 95 parts of methanol to prepare a paint for an intermediate (undercoating) layer, which was then applied by dipping onto the above-formed electroconductive layer and dried at 100° C. for 20 min. to form a 0.6 μm-thick intermediate layer.

Then, 3 parts of oxytitanium phthalocyanine (providing main peaks specified by bragg angles (2θ±0.2 deg.) of 9.0 deg., 14.2 deg., 23.9 deg. and 27.1 deg. in X-ray analysis using CuKα characteristic X-ray. 2 parts of polyvinyl butyral resin ("S-LEC BM2", mfd. by Sekisui Kagaku K.K.) and 35 parts of cyclohexanone were dispersed for 2 hours in a sand mill containing 1 mm-dia. glass beads, and further diluted with 60 parts of ethyl acetate to prepare a paint for a charge generation layer, which was applied by dipping onto the above-formed intermediate layer and dried at 100° C. for 15 min. to form a 0.2 μm-thick charge generation layer.

Then, 7 parts of a charge-transporting material shown below and 10 parts of Compound No. 5 (a functional compound shown in Table 1) was dissolved in a mixture solvent of dichloromethane 20 parts/toluene 40 parts to prepare a paint for a charge transport layer.

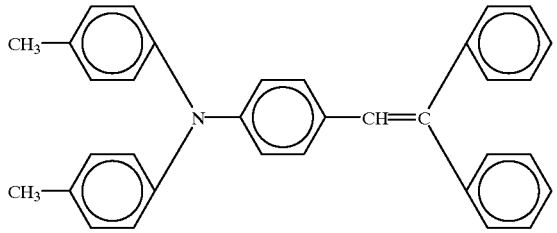

The paint was then applied by dipping onto the above formed charge generation layer, dried at 120° C. for 60 min. in nitrogen gas atmosphere and cured by irradiation with electron beam at an acceleration voltage of 150 kV and a dose of 30 Mrad in nitrogen gas atmosphere to form a 20 μm-thick charge transport layer, thus obtaining an electrophotographic photosensitive member. The photosensitive layer after the radiation (electron beam) curing showed a relative dielectric constant of 2.7.

The thus-prepared electrophotographic photosensitive member was evaluated with respect to electrophotographic performances and durability, anti-precipitation property and anti-cracking property.

The electrophotographic performances and durability were evaluated by incorporating the photosensitive member into a commercially available laser beam printer ("LBP-EX", mfd. by Canon K.K.) to effect a continuous image forming test. As initial photosensitive member performances, a dark potential Vd was set to −700 volts, and a photo-attenuation sensitivity ($E_{150}$: light quantity required for attenuating the dark potential (Vd) of −700 volts to a light potential Vl=−150 volts) and residual potential ($V_{sl}$: potential after exposure to a light quantity of three times the photo-attenuation sensitivity (=3×$E_{150}$)) were measured. Then, the photosensitive member was subjected to a durability test (continuous image forming test) on 10,000 sheets, and then subjected to observation of image defects with eyes, abrasion amount and measurement of the photosensitive member performances after the continuous image forming test to measure changes of respective performances, i.e., Vd (change in dark potential under an identical primary charging condition), Vl (change in Vl when exposed to the light quantity ($E_{150}$) giving Vl=150 volts at the initial stage) and Vsl (change in Vsl when exposed to 3×$E_{150}$). The abrasion amount was measured by using an eddy-current thickness meter ("PERMASCOPE TYPE E111", mfd. by Fischer Co.).

The results are shown in Table 2 appearing hereinafter.

In table 2, a positive value for the potential change means an increase in potential as an absolute value and a negative value for the potential charge represents a negative potential.

The anti-precipitation property and the anti-solvent cracking property were respectively evaluated by using another photosensitive member prepared in the same manner as that for evaluating the electrophotographic performances in the following manner.

The anti-precipitation property was evaluated by pressing an urethane rubber-made cleaning blade for a copying machine against the photosensitive member surface and the photosensitive member was stored at 75° C. (as an acceleration test) for 30 days (maximum) to observe the photosensitive member surface every 24 hours as to the presence or absence of precipitation through a microscope.

The anti-cracking property was evaluated by attaching a finger fat to the surface of the photosensitive member surface and left standing for 2 days in a normal temperature/normal humidity environment to observe the photosensitive member surface every 24 hours as the presence or absence of solvent cracking through a microscope.

The results are shown in Table 3 appearing hereinafter.

EXAMPLES 2–5

Electrophotographic photosensitive members were prepared and evaluated in the same manner as in Example 1 except that Compound No. 5 was changed to the following compounds, respectively.

| Ex. No. | Compound(s) | Weight ratio |
|---|---|---|
| 2 | No. 10 | — |
| 3 | No. 5/No. 39 | 4/6 |
| 4 | No. 7 | — |
| 5 | No. 1/No. 39 | 1/1 |

The results are shown in Tables 2 and 3.

As shown in Table 2, the photosensitive members according to the present invention showed good electrophotographic performances at the initial stage and after the durability test, the abrasion was little and very little changes in photosensitive member performances were observed, thus exhibiting very stable and good performances.

Further, as shown in Table 3, the photosensitive members did not cause precipitation and cracking.

Comparative Examples 1 and 2

Electrophotographic photosensitive members were prepared and evaluated in the same manner as in Example 1 except that Compound No. 5 was charged to a bisphenol Z-type polycarbonate (weight-average molecular weight (Mw)=20,000) for Comparative Example 1 or a polymethylmethacrylate (Mw=40,000) for Comparative Example 2, respectively, and the irradiation with electron beam was not effected.

The results are shown in Tables 2 and 3.

As shown in Tables 2 and 3, the (comparative) photosensitive members showed larger abrasion amounts and caused image defects, such as fogs and occurrences of precipitation and cracking.

Comparative Example 3

An electrophotographic photosensitive member was prepared and evaluated in the same manner as in Example 1 except that Compound No. 5 was cured by heating at 140° C. for 60 min. in a nitrogen gas atmosphere, instead of the electron beam irradiation, in the presence of 10 parts of a polymerization initiator represented by the following formula.

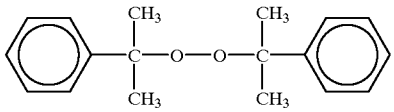

The results are shown in Tables 2 and 3.

As apparent from Tables 2 and 3, in the case of hot curing of the functional compound (Compound No. 5), the resultant photosensitive member showed a low photosensitivity and a high residual potential at an initial stage, thus leading to a lower image density and an unclear image.

TABLE 2

| | Performance evaluation results | | | | | | | | |
|---|---|---|---|---|---|---|---|---|---|
| | | Performance | | | | | | | |
| | | Initial | | | After 1000 sheets | | | | |
| | Relative dielectric constant | Vd (V) | Sensitivity ($\mu$J/cm$^2$) | Vsl (V) | *2 Image | Abrasion ($\mu$m) | Potential change Vd (V) | Vl (V) | Vsl (V) |
| Ex. | | | | | | | | | |
| 1 | 2.7 | −705 | 0.31 | −90 | A | 2.3 | 0 | 5 | 15 |
| 2 | 2.8 | −705 | 0.32 | −100 | A | 2.0 | 5 | 5 | 15 |
| 3 | 2.9 | −700 | 0.30 | −70 | A | 1.8 | 5 | 15 | 15 |
| 4 | 3.0 | −700 | 0.35 | −90 | A | 2.5 | 10 | 0 | 5 |
| 5 | 2.9 | −705 | 0.35 | −80 | A | 2.1 | 5 | 10 | 10 |
| Comp. Ex. 1 | 3.0 | −700 | 0.28 | −70 | B1 | 12.0 | 30 | −70 | 10 |
| " 2 | 3.0 | −700 | 0.30 | −80 | B2 | 18.0 | 390 | 120 | 20 |
| " 3 | 3.1 | −700 | −*1 | −250 | C | 4.5 | — | — | — |

TABLE 2-continued

| Performance evaluation results | | | | | | | | | |
|---|---|---|---|---|---|---|---|---|---|
| | Performance | | | | | | | | |
| | Initial | | | | After 1000 sheets | | | | |
| Relative dielectric constant | Vd (V) | Sensitivity ($\mu J/cm^2$) | Vsl (V) | *2 Image | Abrasion ($\mu m$) | Potential change Vd (V) | Vl (V) | Vsl (V) |

(Notes to Table 2)
*1: The surface potential (−700 V) failed to be attenuated to −150 V.
*2: Image qualities were evaluated according to the following standard.
A: Good images were attained.
B1: Image density was lowered at 8000 sheets or above.
B2: Fog occurred at 5000 sheets or above.
C: Images were unclear from the initial stage.

TABLE 3

| Ex. No. | Precipitation | Cracking After 24 hr. | Cracking After 2 days |
|---|---|---|---|
| 1 | Not observed | Not observed | Not observed |
| 2 | " | " | " |
| 3 | " | " | " |
| 4 | " | " | " |
| 5 | " | " | " |
| Comp. Ex. 1 | Observed after 20 days | " | Observed |
| Comp. Ex. 2 | Observed after 3 days | Observed | " |
| Comp. Ex. 3 | Not observed | Not observed | Not observed |

EXAMPLES 6–9

Electrophotographic photosensitive members were prepared and evaluated in the same manner as in Example 1 except that Compound No. 5 was charged to Compound No. 21 (Ex. 6), Compound No. 34 (Ex. 7), Compound No. 36 (Ex. 8) and Compound No. 37 (Ex. 9), respectively.

The results are shown in Tables 5 and 6 appearing hereinbelow.

As shown in Tables 5 and 6, the photosensitive members showed good electrophotographic characteristics and no precipitation and cracking. When the relative dielectric constant exceeded 4.0, the resultant photosensitivity was somewhat lowered and the residual potential was somewhat increased but were of practically acceptable levels.

EXAMPLES 10–14

Electrophotographic photosensitive members were prepared and evaluated in the same manner as in Example 1 except that the electron beam irradiation conditions were changed to those shown in Table 4 below.

TABLE 4

| Ex. No. | Acceleration voltage (kV) | Dose (Mrad) |
|---|---|---|
| 10 | 200 | 30 |
| 11 | 300 | 30 |
| 12 | 150 | 80 |
| 13 | 150 | 150 |
| 14 | 150 | 200 |

The results are shown in Tables 5 and 6.

As shown in Tables 5 and 6, the photosensitive members showed good electrophotographic characteristics and no precipitation and cracking. In the case of exceeding an acceleration voltage of 250 kV and a dose of 100 Mrad, there were tendencies for the photosensitivity to decrease and for the residual potential to increase but these were of practically acceptable level.

TABLE 5

| Performance evaluation results | | | | | | | | | |
|---|---|---|---|---|---|---|---|---|---|
| | Performance | | | | | | | | |
| | Initial | | | | After 10000 sheets | | | | |
| Ex. | Relative dielectric constant | Vd (V) | Sensitivity ($\mu J/cm^2$) | Vsl (V) | Image | Abrasion ($\mu m$) | Potential change Vd (V) | Vl (V) | Vsl (V) |
| 6 | 2.8 | −705 | 0.30 | −80 | A | 2.3 | 5 | 5 | 15 |
| 7 | 4.2 | −705 | 0.43 | −140 | A | 3.2 | 5 | 10 | 10 |

TABLE 5-continued

| | | Performance evaluation results | | | | | | | |
|---|---|---|---|---|---|---|---|---|---|
| | | Performance | | | | | | | |
| | | Initial | | | After 10000 sheets | | | | |
| | | | | | | | Potential change | | |
| Ex. | Relative dielectric constant | Vd (V) | Sensitivity ($\mu$J/cm$^2$) | Vsl (V) | Image | Abrasion ($\mu$m) | Vd (V) | Vl (V) | Vsl (V) |
| 8 | 4.4 | −700 | 0.48 | −140 | A | 3.9 | 15 | −10 | −25 |
| 9 | 4.2 | −700 | 0.43 | −140 | A | 3.8 | 15 | −10 | −15 |
| 10 | 2.7 | −705 | 0.32 | −90 | A | 2.3 | 0 | 5 | 15 |
| 11 | 3.0 | −700 | 0.35 | −100 | A | 2.3 | 0 | 10 | 20 |
| 12 | 2.8 | −695 | 0.34 | −90 | A | 2.2 | 5 | 10 | 5 |
| 13 | 3.1 | −695 | 0.39 | −130 | A | 3.0 | 10 | −10 | −15 |
| 14 | 3.5 | −700 | 0.43 | −150 | A | 3.5 | 10 | −20 | −30 |

TABLE 6

| | | Cracking | |
|---|---|---|---|
| Ex. No. | Precipitation | After 24 hr. | After 2 days |
| 6 | Not observed | Not observed | Not observed |
| 7 | " | " | " |
| 8 | " | " | " |
| 9 | " | " | " |
| 10 | " | " | " |
| 11 | " | " | " |
| 12 | " | " | " |
| 13 | " | " | " |
| 14 | " | " | " |

As described hereinabove, according to the present invention, the use of the radiation-cured resin in the photosensitive layer provided the resultant photosensitive member with excellent anti-precipitation property, anti-cracking property, and resistances to abrasion and marring, good electrophotographic characteristics in terms of photosensitivity and residual potential and stable higher performances even in repetitive use. It is also possible to provide a process cartridge and an electrophotographic apparatus using such an excellent photosensitive member and a process for producing the photosensitive member.

What is claimed is:

1. An electrophotographic photosensitive member, comprising: a support and a photosensitive layer disposed on the support, wherein the photosensitive layer comprises a charge-transporting material and a resin obtained by radiation curing of a monomer compound having two or more functional groups each represented by the following formula (1):

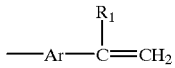

(1)

wherein Ar denotes a substituted or unsubstituted arylene group and R, denotes a hydrogen atom or methyl group, said monomer compound being free from a charge-transporting property.

2. A member according to claim 1, wherein Ar is an arylene group obtained by subtracting two hydrogen atoms from benzene, naphthalene, anthracene or pyrene.

3. A member according to claim 1, wherein said photosensitive layer has a relative dielectric constant of at most 4.0.

4. A member according to claim 1, wherein said photosensitive layer has a relative dielectric constant of at most 3.0.

5. A member according to claim 1, wherein said photosensitive layer comprises a charge generation layer and a charge transport layer, and the charge transport layer comprises said charge-transporting material and said resin.

6. A member according to claim 1, wherein said photosensitive layer is formed by applying a solution containing said monomer compound and irradiating said monomer compound with a radiation.

7. A member according to claim 6, wherein said solution further contains a charge-transporting material.

8. A member according to claim 1, wherein said radiation is an electron beam.

9. A member according to claim 8, wherein said electron beam is irradiated at an acceleration voltage of at most 250 kV.

10. A member according to claim 9, wherein said acceleration voltage is at most 150 kV.

11. A member according to claim 8, wherein said electron beam is irradiated at a dose of 1–100 Mrad.

12. A member according to claim 11, wherein said dose is 3–50 Mrad.

13. A process cartridge, comprising: an electrophotographic photosensitive member and at least one means selected from the group consisting of charging means, developing means and cleaning means; said electrophotographic photosensitive member and said at least one means being integrally supported and detachably mountable to a main assembly of an electrophotographic apparatus, wherein said electrophotographic photosensitive member is an electrophotographic photosensitive member according to claim 1.

14. An electrophotographic apparatus, comprising:

an electrophotographic photosensitive member, and charging means, exposure means, developing means and transfer means respectively disposed opposite to the electrophotographic photosensitive member, wherein said electrophotographic photosensitive member is an electrophotographic photosensitive member according to claim 1.

* * * * *

UNITED STATES PATENT AND TRADEMARK OFFICE

CERTIFICATE OF CORRECTION

PATENT NO. : 6,372,397 B1
DATED : April 16, 2002
INVENTOR(S) : Akio Maruyama et al.

It is certified that error appears in the above-identified patent and that said Letters Patent is hereby corrected as shown below:

Title page,
Item [56], References Cited, FOREIGN PATENT DOCUMENTS,
"JP 143645 1/2000" should read -- JP 54-143645 11/1979 --.

Column 3,
Line 27, "including-an" should read -- including an --.

Column 4,
Line 41, "compound"" should read -- compound") --; and
Line 52, "material" should read -- material) --.

Column 17,
Line 38, "form" should read -- from --.

Column 18,
Line 7, "in" should read -- is --;
Line 58, "cartridge" should read -- cartridge 11 --; and
Line 66, "electrophotographic" should read -- electrophotographic apparatus --.

Column 19,
Line 27, "contacting" should read -- containing --.

Column 20,
Line 54, "table 2," should read -- Table 2, --.

Column 21,
Line 42, "charged" should read -- changed --.

UNITED STATES PATENT AND TRADEMARK OFFICE

CERTIFICATE OF CORRECTION

PATENT NO. : 6,372,397 B1
DATED : April 16, 2002
INVENTOR(S) : Akio Maruyama et al.

It is certified that error appears in the above-identified patent and that said Letters Patent is hereby corrected as shown below:

Column 22,
Table 2, “1000 sheets” should read -- 10000 sheets --.

Column 23,
Table 2-continued, “1000 sheets” should read -- 10000 sheets --; and
Line 40, “charged” should read -- changed --.

Signed and Sealed this

Twelfth Day of November, 2002

*Attest:*

*Attesting Officer*

JAMES E. ROGAN
*Director of the United States Patent and Trademark Office*